US007051819B1

(12) United States Patent
Schenk

(10) Patent No.: US 7,051,819 B1
(45) Date of Patent: May 30, 2006

(54) MEANS FOR CREATING WEEP HOLES IN A RIDGE OF ROADWAY MATERIAL

(76) Inventor: Douglas G. Schenk, 13185 W. Pearl, Prosser, NE (US) 68883

( * ) Notice: Subject to any disclaimer, the term of this patent is extended or adjusted under 35 U.S.C. 154(b) by 0 days.

(21) Appl. No.: 11/056,644

(22) Filed: Feb. 11, 2005

(51) Int. Cl.
*E02F 3/815* (2006.01)
*E02F 3/76* (2006.01)

(52) U.S. Cl. ..... 172/815; 172/784; 172/782

(58) Field of Classification Search ..... 37/381, 37/382, 903; 172/780, 781, 784, 815, 782
See application file for complete search history.

(56) References Cited

U.S. PATENT DOCUMENTS 879,970 A * 2/1908 Kruse ..... 172/784
2,594,727 A * 4/1952 Burggren ..... 172/815
2,646,633 A * 7/1953 Jahn ..... 172/782
3,039,209 A * 6/1962 Cron et al. ..... 37/403
3,061,955 A * 11/1962 Violette ..... 172/815
3,148,466 A * 9/1964 Batko ..... 172/781
3,340,681 A * 9/1967 Strawbridge ..... 56/229
3,429,381 A * 2/1969 Launder et al. ..... 172/815
3,605,167 A * 9/1971 Martel et al. ..... 15/236.05
4,223,461 A * 9/1980 Tackitt ..... 172/815
4,575,278 A * 3/1986 Whitney ..... 404/72
4,962,600 A * 10/1990 Zellaha et al. ..... 37/280
6,523,620 B1 * 2/2003 Burson ..... 172/815

* cited by examiner

*Primary Examiner*—Thomas B. Will
*Assistant Examiner*—Alexandra Pechhold
(74) *Attorney, Agent, or Firm*—Thomte, Mazour & Niebergall; Dennis L. Thomte

(57) ABSTRACT

A weep hole blade is operably mounted on the heel of the grader blade of a motor grader which is movable between raised and lowered positions with respect to the grader blade to create weep holes or channels in a ridge of roadway material being deposited at the side of a road by the motor grader.

5 Claims, 5 Drawing Sheets

MEANS FOR CREATING WEEP HOLES IN A RIDGE OF ROADWAY MATERIAL

BACKGROUND OF THE INVENTION

1. Field of the Invention

This invention relates to a means for creating weep holes in a ridge of roadway material and more particularly to an apparatus which is attached to the heel of a motor grader blade to enable the operator of the motor grader to create weep holes in a ridge of roadway material at the same time as the motor grader is forming the ridge.

2. Description of the Related Art

Motor graders, which are sometimes called road graders, maintainers, etc., include a wheeled frame have a grader blade movably mounted thereon. The motor grader includes means for raising and lowering the blade and angling the same. The operator of the motor grader may manipulate the blade so that the same will dig, scrape or grade roadway material and direct the same rearwardly and outwardly with respect to the motor grader so that a ridge or windrow of roadway material is deposited adjacent the side or shoulder of the roadway. The roadway material may be gravel, dirt, crushed rock such as limestone, or combinations thereof. The ridge or windrow will remain at the side of the roadway for some time until the motor grader is utilized to spread the ridge of roadway material back onto the main portion of the roadway. The ridge or windrow will adversely act as a dam during periods of rainfall which will prevent the water from draining into the ditch adjacent the roadway. Since the surface water cannot drain into the ditch adjacent the roadway, the water collects on the roadway inwardly of the ridge and creates a traffic hazard.

It has therefore become a custom or practice to create weep holes or channels in the ridge of roadway material. The same is normally accomplished by making another pass with the motor grader after the ridge has been initially formed with the blade of the motor grader being lowered down into the ridge of roadway material to create the weep hole or channel therein. Normally, when the roadway slopes downwardly, the blade of the motor grader will be angled so that the weep holes extend downwardly and outwardly in the ridge of material. Likewise, when the roadway slopes upwardly, the grader blade will be angled so that the weep hole will extend downwardly and outwardly so that the water moving down the slope of the road will be directed into the uphill side of the weep hole to facilitate the drainage of the water through the weep holes.

The standard practice described above is time-consuming and requires that the motor grader make an additional pass to crate the weep holes.

SUMMARY OF THE INVENTION

An apparatus is described for use in combination with a motor grader having a wheeled frame with a movable grader blade mounted thereon with the blade having a heel and a toe. A mount is secured to the grader blade adjacent the heel thereof and has an elongated support, having inner and outer ends, secured thereto. The inner end of the elongated support is operably pivotally mounted to the mount so that the outer end of the elongated support may be selectively moved between raised and lowered positions. A weep hole blade is operably secured to the elongated support for movement therewith between raised and lowered positions. The weep hole blade, when moved from its raised position to its lowered position creates a weep hole or channel in a ridge of roadway material created by the grader blade and moved outwardly of the heel thereof. Preferably, the weep hole blade is selectively angularly movable, about a general vertical axis, with respect to the grader blade. A motor is operatively connected to the elongated support which moves the weep hole blade from its raised position to its lowered position. A spring is operatively connected to the elongated support which returns the weep hole blade from its lowered position to its raised position.

It is therefore a principal object of the invention to provide a means for creating weep holes in a ridge of roadway material.

A further object of the invention is to provide a means for creating weep holes in a ridge of roadway material by means of an apparatus which is attached to the heel of the grader blade of a motor grader and which eliminates the need for a separate pass of the motor grader to create the weep holes after the ridge has been formed.

Still another object of the invention is to provide a means for creating weep holes in a ridge of roadway material which may be angled with respect to the blade so that the weep holes may extend from the roadway downwardly and forwardly when the roadway slopes downwardly and which extends downwardly and outwardly when the roadway slopes upwardly.

A further object of the invention is to provide a means for creating weep holes in a ridge of roadway material which is durable in use, refined in appearance and economical of manufacture.

These and other objects will be apparent to those skilled in the art.

DETAILED DESCRIPTION OF THE INVENTION

Figure 1:
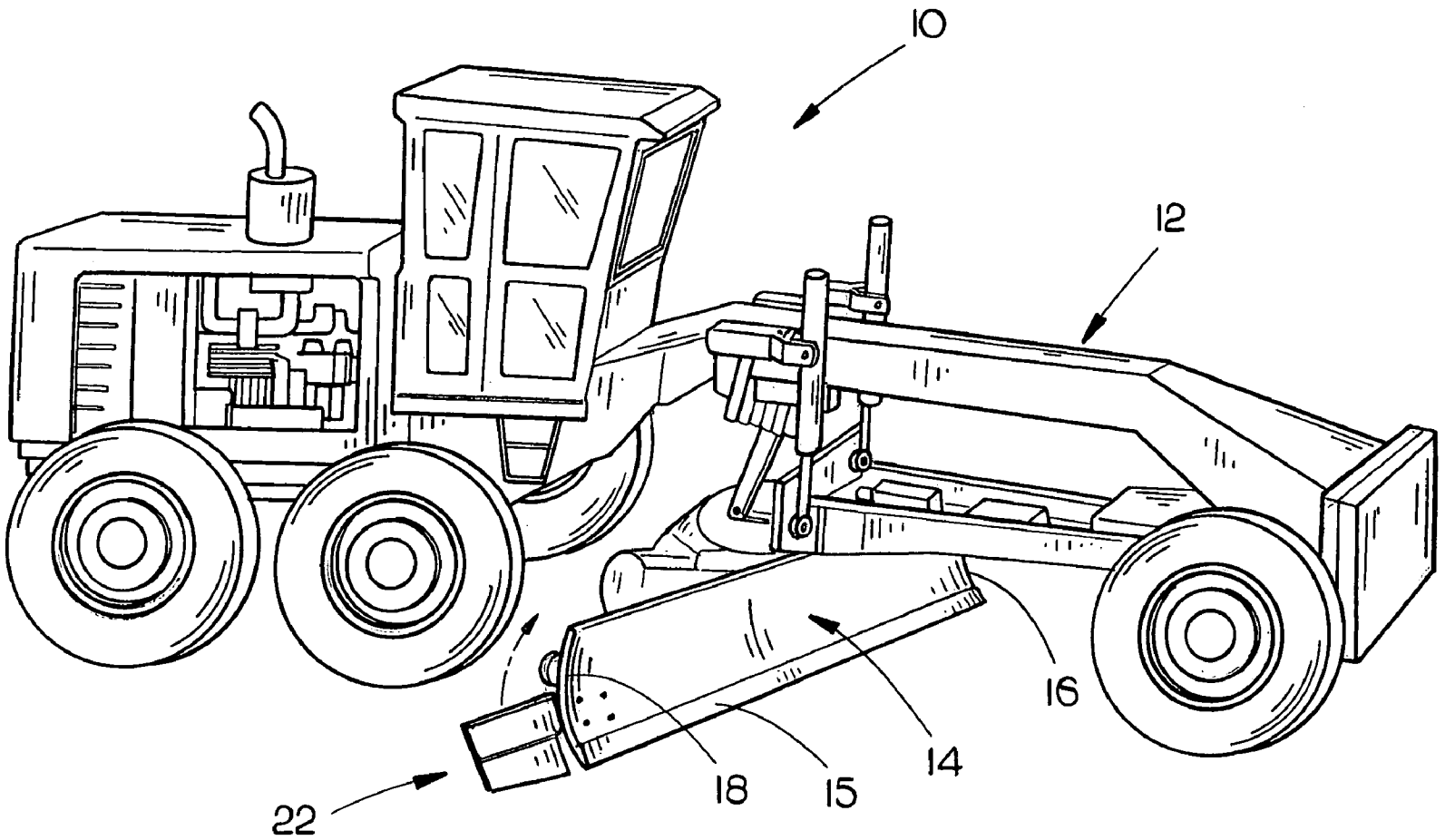
FIG. 1 is a perspective view of a motor grader having the apparatus of this invention mounted on the heel of the grader blade.
Figure 2:
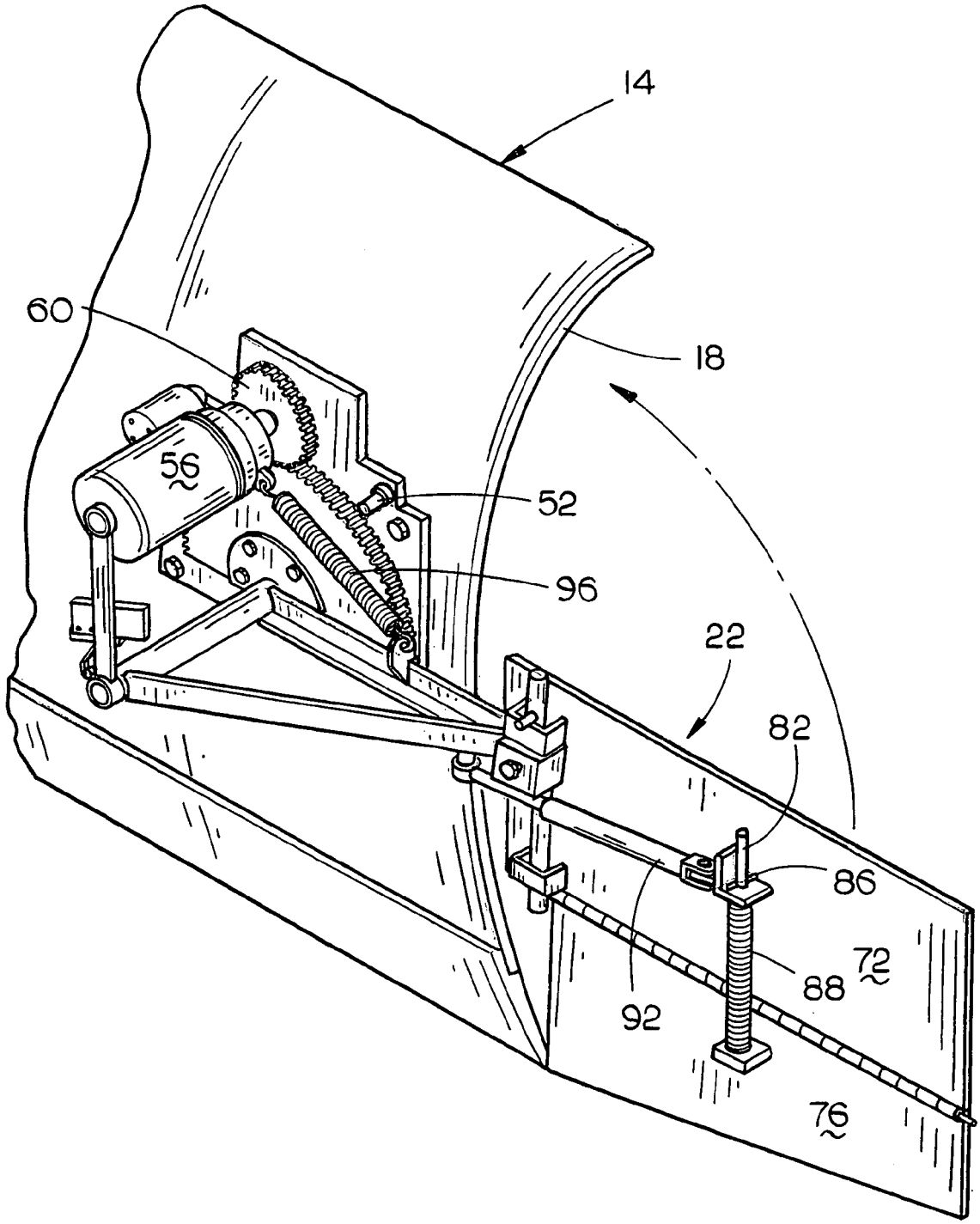
FIG. 2 is a rear perspective view of the apparatus of this invention mounted on the grader blade.
Figure 5:
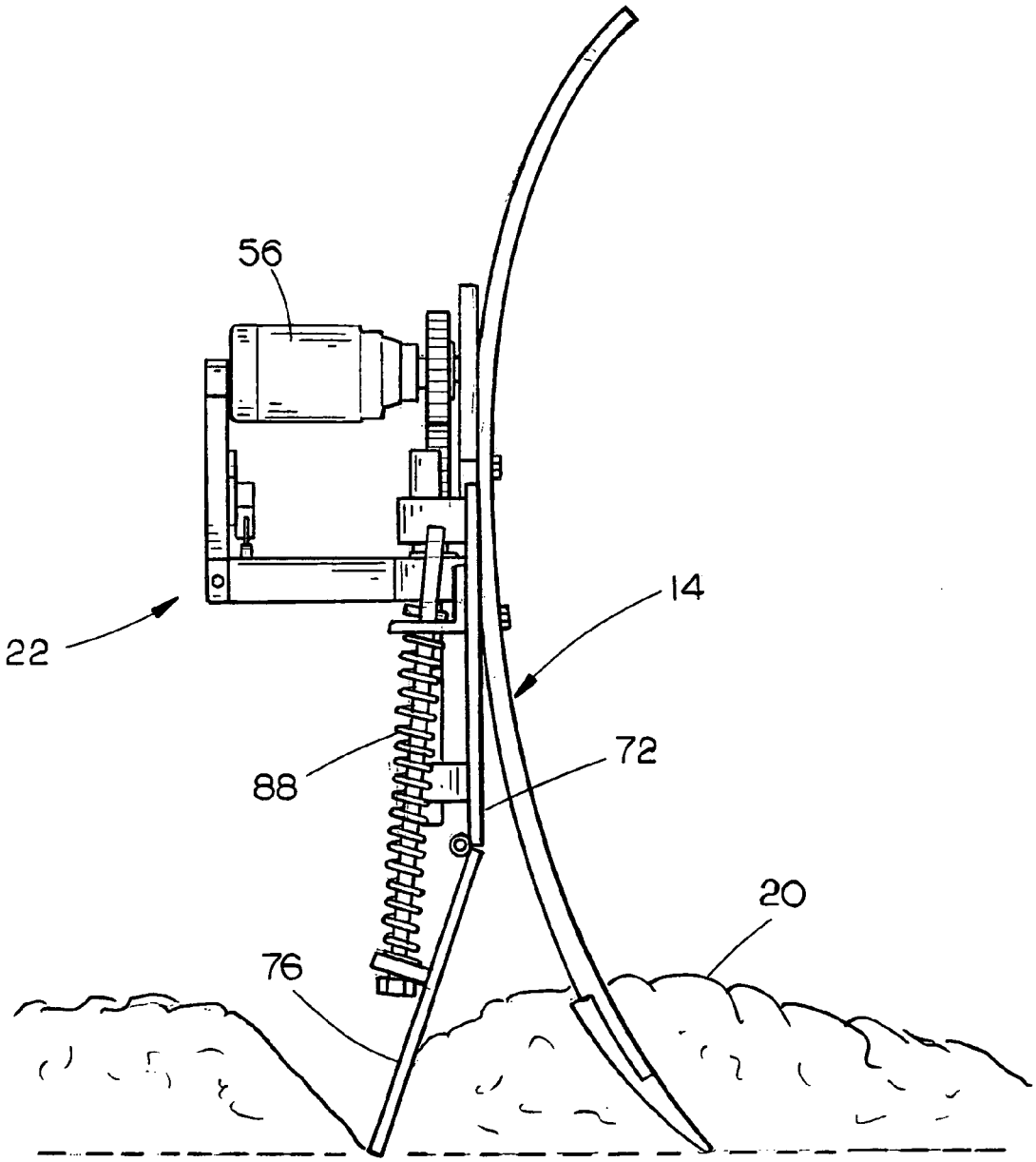
FIG. 5 is an end view of the apparatus.

The numeral 10 refers to a conventional motor grader sometimes called a road grader, a maintainer, etc. Motor grader 10 includes a wheeled frame 12 having a blade 14 movably mounted thereon in conventional fashion. Blade 14 is also frequently called a mold board. The operator of the motor grader 10 can raise and lower the blade 14 and angle the same. Blade 14 includes a selectively removable blade portion 15 which will wear and which will be eventually replaced. In the position of FIG. 1, the leading end 16 of the blade 14 is referred as the "toe" of the blade and the trailing edge 18 is referred to as the "heel" of the blade. When the blade 14 is in the roadway engaging position of FIGS. 1 and 5, the blade will dig, scrape or grade roadway material and direct the same rearwardly and outwardly with respect to the motor grader 10 so that a ridge or windrow 20 of roadway material is deposited adjacent the side or shoulder of the roadway. The roadway material may be gravel, dirt, crushed rock such as limestone, or combinations thereof. Normally, as previously stated, the ridge or windrow will remain at the side of the roadway for some time until the motor grader is utilized to spread the ridge 20 of roadway material back onto the main portion of the roadway. As also previously stated hereinabove, the ridge or windrow 20 will adversely act as a dam during periods of rainfall and will prevent the water on the roadway from draining into the ditch adjacent the roadway. Inasmuch as the surface water cannot drain into the ditch adjacent the roadway, the water collects on the roadway inwardly of the ridge 20 and creates a traffic hazard.

The numeral 22 refers to the apparatus of this invention which will create "weep holes" or channels in the ridge 20 so that the rain water on the roadway may drain therethrough into the ditch. Apparatus 22 includes a plate, mount or support 24 (hereinafter referred to as "plate") which is utilized to mount the apparatus on the heel 18 of the blade 14. Plate 24 is preferably selectively bolted or otherwise secured to the back of blade 14 so as to generally dwell in the same plane as blade 14. Plate 24 includes front face 26, back face 28, inner end 30, outer end 32, upper end 34 and lower end 36.

Figure 3:
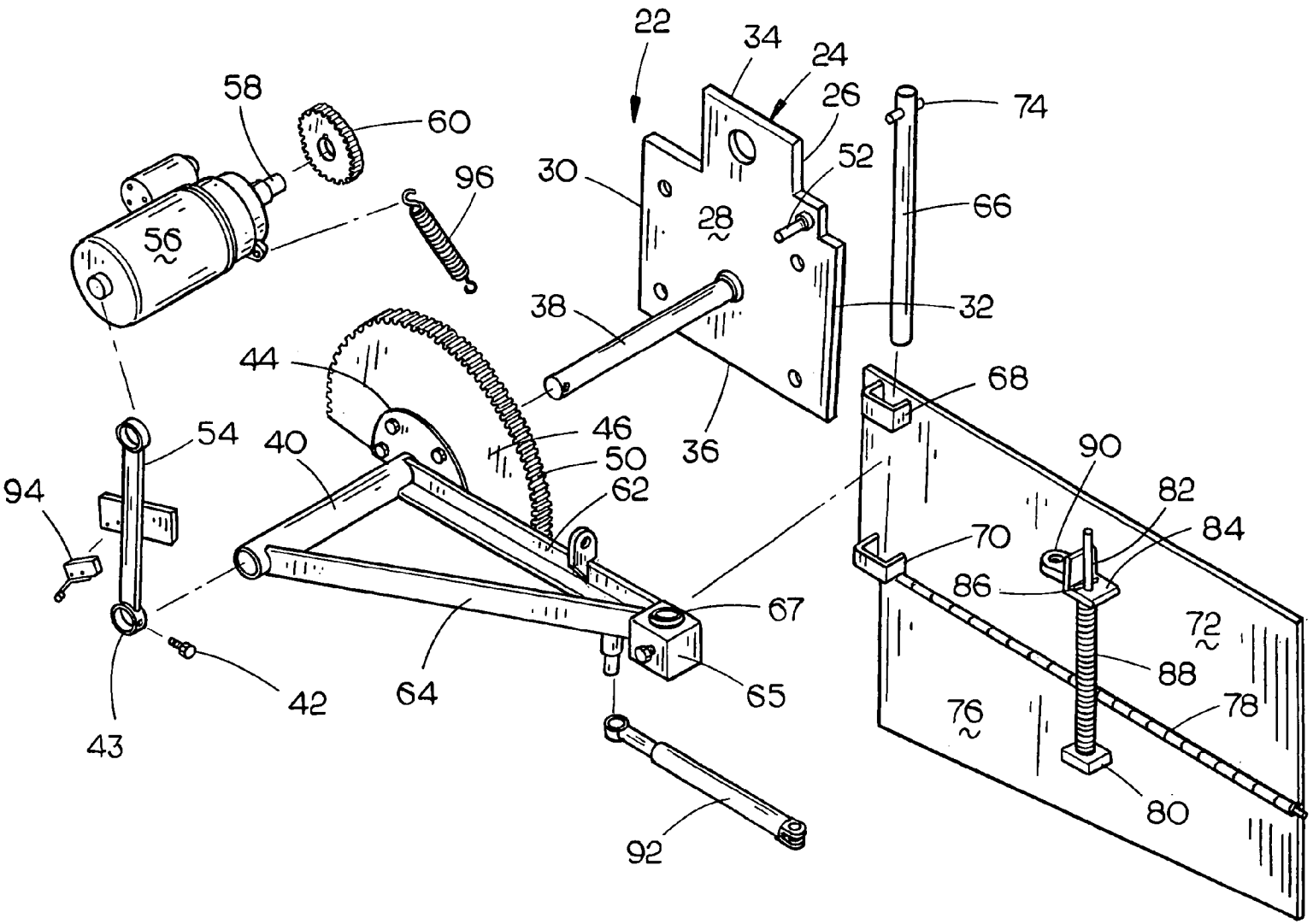
FIG. 3 is an exploded perspective view of the apparatus of this invention.

Axle or shaft 38 has its forward end rigidly secured to plate 24 and extends rearwardly therefrom in a transverse manner with respect to plate 24. Tube or pipe 40 is rotatably mounted on axle 38 and is held thereon by means of bolt 42 extending through collar 43, which is mounted on the end of axle 38. A plate or hub 44 is welded to the forward end of tube 40 and has a drive wheel, sprocket or flywheel 46 secured thereto by bolts 48. As seen in the drawings, drive wheel 46 has a plurality of spaced-apart drive teeth 50 formed in its periphery. Stop 52 extends rearwardly from the upper end of plate 24, as seen in FIG. 3, for a purpose described hereinafter.

Support 54 is secured at one end to collar 43 by welding and extends laterally inwardly therefrom. The other end of support 54 supports one end of electric motor 56, such as a vehicle starter motor, which preferably is the same voltage as the electrical system of the motor grader 10. The other end of motor 56 is operably secured to and supported by the plate 24. Motor 56 includes a drive shaft 58 having a gear 60 mounted thereon which is in mesh with the drive teeth 50 on drive wheel 46 so that actuation of motor 56 will cause drive wheel 46 to rotate in a clockwise direction as viewed from the rear of the apparatus 22.

Support arm 62 has its inner end welded to tube 40 closely adjacent hub 44 and extends generally transversely outwardly therefrom. The inner end of support arm 64 is welded to tube 40 and extends outwardly at an angle therefrom so that its outer end is positioned adjacent the outer end of support arm 62 (FIG. 3). A support 65 is welded to the outer ends of support arms 62 and 64 so that sleeve 67 therein is generally disposed transversely to the longitudinal axis of support arm 62. An elongated support pipe 66 is received within sleeve 67. Support pipe 66 is received by collars 68 and 70. The forward sides of collars 68 and 70 have one end of a generally rectangular plate 72 welded thereto for movement therewith. Bolt 74 extends through support pipe 66 above collar 68 to limit the downward movement of plate 72 with respect to support pipe 66. Preferably, a lower blade or plate 76 is hingedly secured to the lower end of plate 72 at 78. Bracket 80 is welded to the rearward side of blade 76 and has the lower end of rod 82 secured thereto which extends upwardly therefrom. Bracket 84 is welded to the rearward side of plate 72 above bracket 84 and has the upper end of rod 82 extending therethrough with bolt 86 extending through rod 82.

Figure 4:
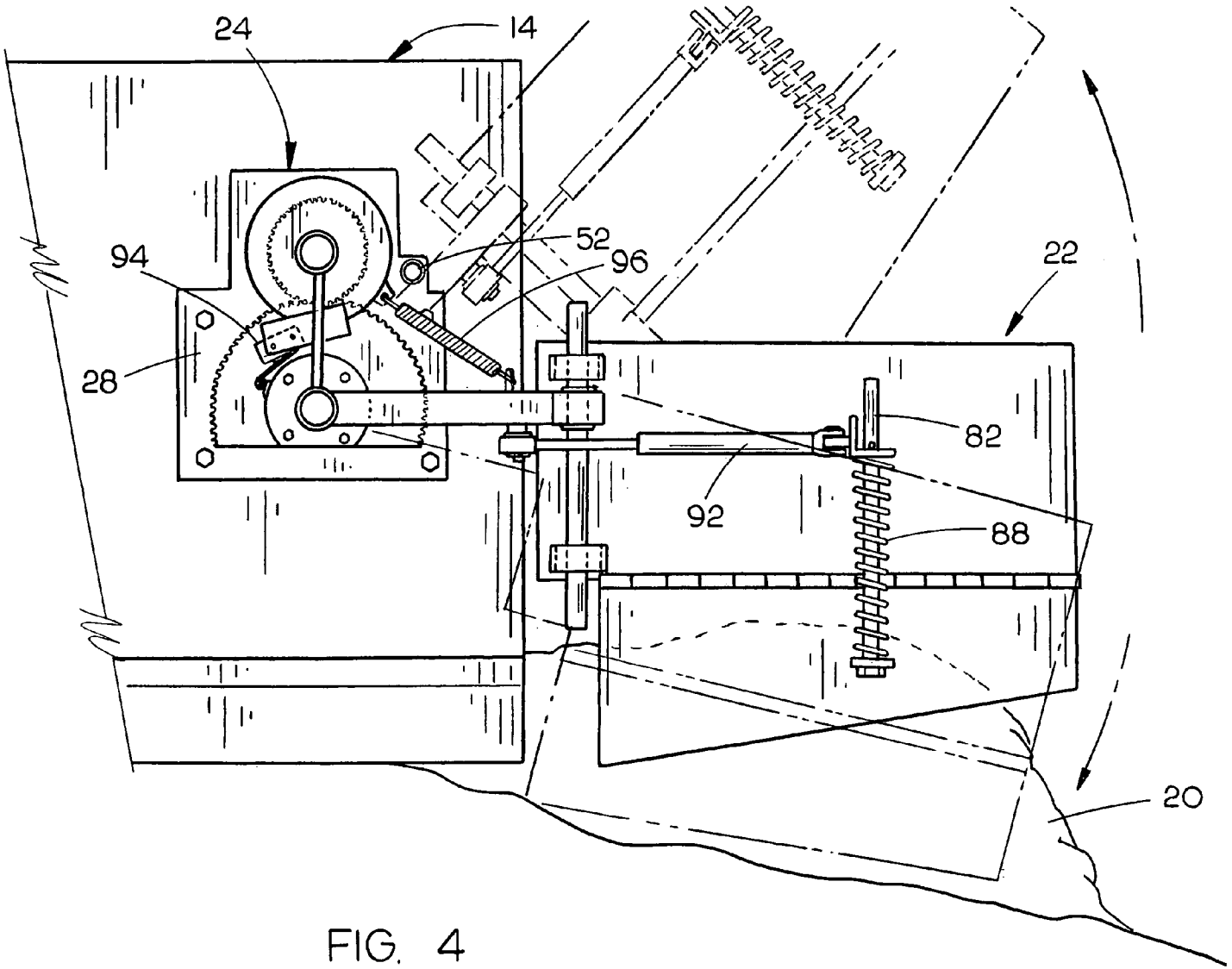
FIG. 4 is a rear view of the apparatus of this invention.

A spring 88 embraces rod 82 between brackets 80 and 84 to yieldably maintain blade 76 in the same plane as plate 72 while permitting the blade 76 to pivot rearwardly with respect to plate 72 against the resistance of spring 88. Preferably, an arm 90 has its outer end secured to bracket 84 and extends inwardly therefrom. Preferably, one end of an electrical elongated actuator or hydraulic cylinder 92 is pivotally connected to the inner end of arm 90 and has its other end connected to one of the support arms 62, 64 or tube 40 to selectively cause the outer ends of plate 72 and blade 76 to be pivotally moved forwardly or rearwardly as a unit. A limit switch 94 is mounted on support 54 in the pivotal path of support arm 62 to stop motor 56 when support arm 64 reaches its predetermined lowermost position. Spring 96 extends between bracket 98 on motor 56 and support arm 62 to yieldably resist the downward movement of support arm 62 and to return the assembly to its raised position of the broken lines in FIG. 4.

In operation, the apparatus 22 of this invention is mounted on the back side of the heel 18 of the blade 14, as previously described. With the motor 56 deenergized, the spring 96 will yieldably maintain the blades 72 and 76 in the upper position, which is illustrated by broken lines in FIG. 4. Stop 52 limits the upper position of the plates 72 and 76. As the motor grader is creating the ridge 20 at one side of the roadway, the motor 56 may be either manually actuated or may be automatically actuated by a suitable control, so that the drive wheel 46 is rotated in a clockwise direction, as viewed from the rear of the apparatus, to lower the plates 72 and 76 from the broken line position of FIG. 4 to the position illustrated in FIG. 4 so that the lower end of the plate or blade 76 is lowered into the ridge 20 to create a weep hole or weep slot therein with the plates 72 and 76 being automatically raised when the limit switch 94 is actuated so that the spring 96 will move the blades 72 and 76 from their lower position to their broken line position of FIG. 4. If the roadway slopes downwardly, the actuator 92 will be extended so that the outer end of the plates 72 and 76 will be positioned forwardly of the inner ends thereof so that the weep holes in the ridge 20 will extend outwardly and forwardly to facilitate the water on the roadway to pass therethrough. Conversely, if the roadway slopes upwardly, the actuator 92 will be retracted so that the weep hole or channel formed in the ridge will extend downwardly and outwardly, also to accommodate the flow of water therethrough.

The pivotal connection of the plate 76 with respect to the plate 72 enables the plate 76 to pivot rearwardly, if necessary, to accommodate wear on the blade portion 15.

Although it is preferred that an electric motor 56 be utilized to raise and lower the assembly, the motor 56 could be replaced by a hydraulic motor, a hydraulic cylinder or a pneumatic cylinder.

Thus it can be seen that the apparatus of this invention accomplishes at least all of its stated objectives.

I claim:

1. In combination with a motorized grader having a wheeled frame with a movable grader blade mounted thereon, the blade having a heel and a toe, comprising:

a mount secured to the grader blade adjacent the heel thereof;

an elongated support having inner and outer ends;

said inner end of said elongated support being operably pivotally mounted to said mount whereby said outer end of said elongated support may be selectively moved between raised and lowered positions;

a weep hole blade operably secured to said elongated support for movement therewith between raised and lowered positions;

said weep hole blade, when moved from its said raised position to its said lowered position creating a weep hole in a ridge of road material created by the grader blade and moved outwardly of the heel thereof;

a motor operatively connected to said elongated support which moves said weep hole blade from its said raised position to its said lowered position;

and a spring operatively connected to said elongated support which returns said weep hole blade from its said lowered position to said raised position.

2. In combination with a motorized grader having a wheeled frame with a movable grader blade mounted thereon, the blade having a heel and a toe, comprising:

a mount secured to the grader blade adjacent the heel thereof;

an elongated support having inner and outer ends;

said inner end of said elongated support being operably pivotally mounted to said mount whereby said outer end of said elongated support may be selectively moved between raised and lowered positions;

a weep hole blade operably secured to said elongated support for movement therewith between raised and lowered positions;

said weep hole blade, when moved from its said raised position to its said lowered position creating a weep hole in a ridge of road material created by the grader blade and moved outwardly of the heel thereof;

said weep hole blade comprising an upper blade portion having a lower blade portion pivotally secured thereto about a generally horizontal axis.

3. The combination of claim 2 wherein said weep hole blade is selectively angularly movable, about a general vertical axis, with respect to the grader blade.

4. The combination of claim 2 wherein an electric motor is operatively connected to said elongated support which moves said elongated support and said weep hole blade from their said raised position to their said lowered position.

5. The combination of claim 2 wherein a spring interconnects said lower blade portion to said upper blade portion, said spring yieldably urging said lower blade portion to a position wherein it is generally in the same plane as said upper blade portion.

* * * * *